United States Patent [19]

Takashima

[11] 4,014,531

[45] Mar. 29, 1977

[54] TUNDISH FOR THE CONTINUOUS CASTING OF STEEL

[75] Inventor: Masaru Takashima, Komae, Japan

[73] Assignee: Aikoh Co., Ltd., Tokyo, Japan

[22] Filed: Apr. 28, 1975

[21] Appl. No.: 572,012

[30] Foreign Application Priority Data

May 15, 1974 Japan ..... 49-53194

[52] U.S. Cl. ..... 266/280; 106/68

[51] Int. Cl.[2] ..... F27D 1/00

[58] Field of Search ..... 110/1 A, 1 B; 266/43, 266/280, 284; 106/68

[56] References Cited

UNITED STATES PATENTS

| | | | |
|---|---|---|---|
| 2,124,865 | 7/1938 | Winkler et al. | 266/43 |
| 3,203,689 | 8/1965 | Hallowell | 266/43 |
| 3,229,970 | 1/1966 | Henry et al. | 266/43 |
| 3,678,143 | 7/1972 | Harnish et al. | 266/43 X |
| 3,737,489 | 6/1973 | Murton | 266/43 X |
| 3,917,110 | 11/1975 | Kiguchi | 266/280 X |

*Primary Examiner*—Roy Lake
*Assistant Examiner*—Paul A. Bell
*Attorney, Agent, or Firm*—Fay & Sharpe

[57] ABSTRACT

A tundish for the continuous casting of steel characterized by lining thereto a moulding which consists of 50–80% by weight of a refractory which bases on silicic anhydride having approximately less than 100 mesh, 2–10% by weight of a refractory clay, 8–20% by weight of a refractory fibrous material and/or a porous refractory and 4–10% by weight of an organic binder, and if necessary 6–10% by weight of a refractory other than silicic anhydride.

4 Claims, 1 Drawing Figure

FIG.
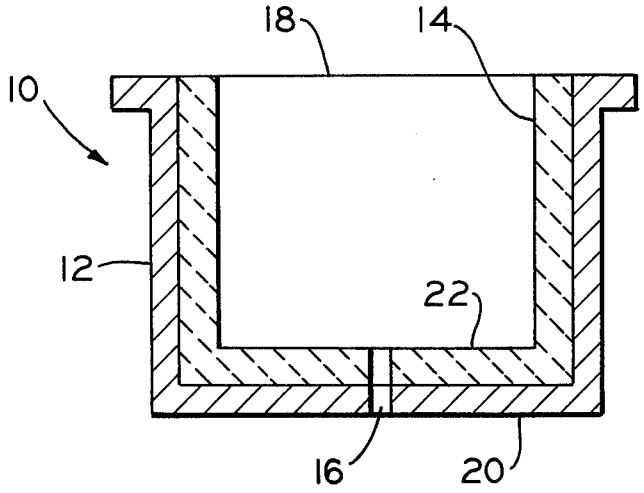

TUNDISH FOR THE CONTINUOUS CASTING OF STEEL

The present invention relates to an improvement in or relating to a moulding for the lining of tundish used for the continuous casting of steel.

The object of using a tundish resides in making pouring speed uniform, so that the tundish takes a pan shape in which the uneveness of molten steel level hardly takes place. Accordingly there are disadvantages if the ratio of inside area to inner capacity becomes too large, a greater heat loss takes place in that the heat of the poured molten steel is absorbed into the inner wall of the tundish, and the temperature of molten steel is greatly lowered. Conventionally tundishes are lined with refractory bricks or a moldable refractory which is refractory and heat-retaining. Although such refractory bricks or moldable refractories have high refractoriness and compression strength they have low heat insulating property, so that they require a greater thickness in order to obtain a desired heat-retaining property, resulting in their use at a state of unnecessarily strong refractoriness and great compression strength and therefore are uneconomical from a cost standpoint. Further, insulating bricks presently used have low refractoriness so as to be incapable of enduring the high temperature such as of molten steel.

The present invention is to provide a moulding which serves both for refractoriness and heat insulating property and which is suitable as a lining material of tundish.

Since the tundish is of the above shape, the depth of molten steel is shallow and the pressure on the lining material is small, the lining material requires little compressive strength and there are firstly required properties which endure spalling caused by heat-retaining property and fluidity of melt. It will suffice if in addition there is a refractoriness to a certain degree, and the lining material of the invention differs in required properties from that of ladle.

In accordance with the invention, a tundish is provided which has a unique inner refractory lining. In the drawing, the tundish of the invention is illustrated in cross section. The tundish 10 is usually cylindrical in shape. It includes an outer cylindrical housing 12 which is usually fabricated from steel. The outer housing is provided with a inner lining of refractory material 14 of the type herein discussed. The housing 12 together with the lining 14 form a cavity 18 for receiving molten metal. The lower portion 20 of the outer housing is provided with an aperture 16 which also extends through the bottom portion 22 of the refractory lining. In practice a molten metal is poured into the cavity 18 and then allowed to flow into the desired mold or container via aperture 16 by conventional means. A tundish is a device which is commonly used in the metal processing industry and accordingly will not be discussed herein in greater detail.

The present moulding is a moulding which is provided with a surface refractoriness and an anti-spalling property by consisting of 50–80% by weight of siliceous sands, silica or the like which based on silicic anhydride of less than 100 mesh, 2–10% by weight of refractory clay, 8–20% by weight of a refractory fibrous material selected from among asbestos, rock wool and slag wool and/or a porous refractory selected from among diatomaceous earth and pearlite, 4–10% by weight of organic binder selected from among starch, dextrin and resins, and if necessary 6–10% by weight of a refractory other than silicic anhydride such as chamotte, peridotite, magnesia, magnesite, dolomite, alumina or the like, and by impregnating the surface of said moulding with an aqueous solution of colloidal silica, water glass, aluminium phosphate or a suspension in which said aqueous solution was suspended with fine powder of zircon sands, alumina and silicic anhydride. The most suitable refractory in the above mixing agents is one which bases on siliceous sands and other silicic anhydrides which have a good anti-spalling property. If the content of the siliceous sands and other silicic anhydrides is less than 50%, refractory property is small and if it exceeds 80% heat insulating property may become short, resulting in unsuitability in both the cases. Refractory clay is employed because of gaining a binding function and a sintering property at high temperatures and if it is less than 2% a binding power is weak and in case it exceeds 10% the porosity of the moulding is decreased to lose heat insulating property, so that both the cases are not suitable. Refractory fibre has the effects of making the moulding light weighted, obtaining a heat insulating property brought about the light weighting, and increasing a bending strength of said moulding. In the case of less than 8% refractory fibre there occurs a bad heat insulating property, and if the fibre is more than 20% the refractoriness is degraded, so that both the cases are unsuitable. Moreover, a porous refractory may sometimes be co-used as a light weight auxiliary agent of the refractory fibre. Organic binder takes advantage of a low heat conductivity and a viscosity at low temperatures, preventing it from breakage when said moulding is not sintered at a high temperature. Less than 4% organic binder in its mixing amount leads to a short binding and more than 10% binder may have a great amount of gas which is generated when using the moulding, thus resulting in an unsuitable condition for both the cases. Refractories other than silicic anhydride are added, if required, because they act with the silicic anhydride to give a sintering property. Since organic binder brings about a lowering of refractoriness it cannot be used. Both less than 6% content and more than 10% content of said refractories brings about a weak sintering property so as to be unsuitable.

A mixed powder body containing each said composition is added with a suitable amount of water to provide a wetness and a fluidity thereto, moulded in either pressurized or pressure-reduced state, dehydrated and released from mould, thereafter drying the moulded body to make an object product.

The moulding having these mixing compositions is of light weight and is rich in a heat insulating property, but sometimes an impregnating agent is impregnated into the surface to an extent of 10 m/m to give a refractory property and an anti-spalling property to the surface. The impregnation is made by containing to the surface portion a large amount of water-soluble refractory and/or suspended fine powder refractory, and the impregnation method may be carried out by any means of applying, inserting under pressure, pressure reducing or the like. Drying is made in the end.

The particle size of refractories must be less than 100 mesh and that of more than 100 mesh is unsuitable because the moudling is likely to break.

The following is mixing examples of the moulding according to the present invention.

| | (1) | (2) |
|---|---|---|
| Siliceous sand (less than 100 mesh) | 42 (%) | 60 (%) |
| Siliceous sand (less than 200 mesh) | 30 | 17 |
| Clay | 5 | 3 |
| Rock wool | 10 | 10 |
| Asbestos | 4 | 4 |
| Diatomaceous earth | 2 | |
| Resins | 6 | 5 |
| Starch | 1 | 1 |
| Impregnating agent (30% aqueous solution of colloidal silica) | 10m/m impregnation | 10m/m impregnation |

The above mouldings could endure a continuous use for 5 hours in tundish of each size.

The mixing example 1 above shows a result in which the refractories have been sticked in 50m/m thickness to the lining of the refractory bricks of tundish, and the mixing example 2 a result in which the refractories have been lined in 100 m/m thickness directly to the outer shell of steel, and a 10 m/m jointing mortar has been applied to the bottom.

I claim:

1. A tundish for the continuous casting of steel characterized by having an inner lining of a moulding which comprises from 50 to 80 percent by weight of a siliceous refractory, based on silicic anhydride, having a particle size less than 100 mesh, from 2 to 10 percent by weight of a refractory clay, from 8 to 20 percent by weight of a refractory fibrous material, and (d) from 4 to 10 percent by weight of an organic binder, with the surface of said molding which is adapted to be in contact with molten metal being impregnated with at least one material selected from the group consisting of colloidal silica, water glass, aluminum phosphate, a suspension of zircon sands, a suspension of alumina, and a suspension of silicic anhydride.

2. A tundish of claim 1 which in addition contains from about 6 to about 10 percent by weight of at least one refractory material selected from the group consisting of chamotte, peridotite, magnesia, magnesite, dolomite and alumina.

3. The tundish of claim 1 wherein said siliceous refractory material is selected from the group consisting of siliceous sand, silica and mixtures thereof.

4. The tundish of claim 1 wherein the refractory fiberous material is selected from the group consisting of asbestos, rock wool, slag wool and mixtures thereof.

* * * * *